United States Patent [19]

Tischer

[11] Patent Number: 4,776,511

[45] Date of Patent: Oct. 11, 1988

[54] PACKAGE

[76] Inventor: Martine Tischer, 23555 N. Highway 45, Mundelein, Ill. 60060

[21] Appl. No.: 83,224

[22] Filed: Aug. 10, 1987

[51] Int. Cl.[4] ..... B65D 5/62; B65D 65/00

[52] U.S. Cl. ..... 229/87 R; 229/125.38

[58] Field of Search ..... 229/87 R, 125.38

[56] References Cited

U.S. PATENT DOCUMENTS

| | | | |
|---|---|---|---|
| 1,116,918 | 11/1914 | Putnam et al. | 229/87 R |
| 1,958,256 | 5/1934 | Yates | 229/87 R |
| 2,155,668 | 4/1934 | Little | 229/87 R |
| 2,651,131 | 9/1953 | Long et al. | 428/4 |
| 2,780,403 | 2/1957 | James | 229/87 R |
| 3,370,779 | 2/1968 | Cole | 428/4 |

FOREIGN PATENT DOCUMENTS

| | | | |
|---|---|---|---|
| 996079 | 8/1976 | Canada | 229/87 R |

*Primary Examiner*—Stephen P. Garbe

*Attorney, Agent, or Firm*—Thomas R. Vigil

[57] ABSTRACT

The package comprises an object to be wrapped, a sheet of uncut negotiable bills of paper-like currency wrapped about the object and means for fastening the wrapped sheet in place. Preferably, a sheet of transparent protective (plastic) material is wrapped around the wrapped sheet of uncut money.

15 Claims, 3 Drawing Sheets

PACKAGE

BACKGROUND OF THE INVENTION

1. Field of the Invention

The present invention relates to a method for wrapping an object with uncut negotiable bills of paper (or paper-like) currency and the package made thereby.

2. Description of the Prior Art

Heretofore various wrapping materials have been proposed for wrapping an object to form a package. In this respect, reference is made to the wrapping paper shown in U.S. Pat. Nos. D.72,252, D.76,978, D.82,542 and D.147,589.

Further, it has been proposed to provide a combined wrapper and catalog in U.S. Pat. No. 1,609,923.

However, heretofore, no one has proposed a method for wrapping a package in a sheet of uncut negotiable bills of paper or paper-like currency, such as uncut dollar bills, or a package so formed as described in greater detail hereinafter.

SUMMARY OF THE INVENTION

According to the present invention, there is provided a method for packaging an object including the steps of:

wrapping a sheet of uncut negotiable paper-like currency about the object, and fastening the wrapped sheet in place.

Further, according to the invention, there is provided a package comprising an object to be wrapped, a sheet of uncut negotiable bills of paper-like currency wrapped about said object and means for fastening the wrapped sheet in place.

The inventive concept disclosed in greater detail hereinafter is directed to the method of taking uncut sheets of money, such as a sheet of uncut dollar bills, and wrapping the sheet about an object to provide an attractive valuable gift.

This concept has a number of advantages. First of all, currency, particularly U.S. paper currency having the color green, is very attractive and suggests power and wealth.

By using uncut sheets of money for wrapping presents, the wrapping will, of course, be carefully removed to open the gift package and it will be carefully cut so that the bills can be separated from the sheet and used as negotiable currency. By using sheets of money for packaging, there will be a saving on wrapping paper, since one will not have to dispose of the wrapping but instead will use wrapping of uncut money.

Also, gifts wrapped in a sheet of uncut money or currency is an exciting way of giving a person a once in a lifetime gift that is special and unusual.

Preferably, the package comprising an object wrapped with a sheet of uncut negotiable paper or paper-like currency will also have a wrapping of clear plastic therearound for protecting the money from being defaced or damaged.

Also, preferably the package will be tied and decorated with a gold cord and a gold tassel. Additionally, if desired, a legend can be placed on the plastic covering reading "MONEY HONEY". Further, to make certain that no one destroys the sheet of uncut negotiable bills of currency, a notice will be placed beneath the clear plastic wrapping reading "GENUINE U.S. CURRENCY".

DESCRIPTION OF THE PREFERRED EMBODIMENT

Figure 1:
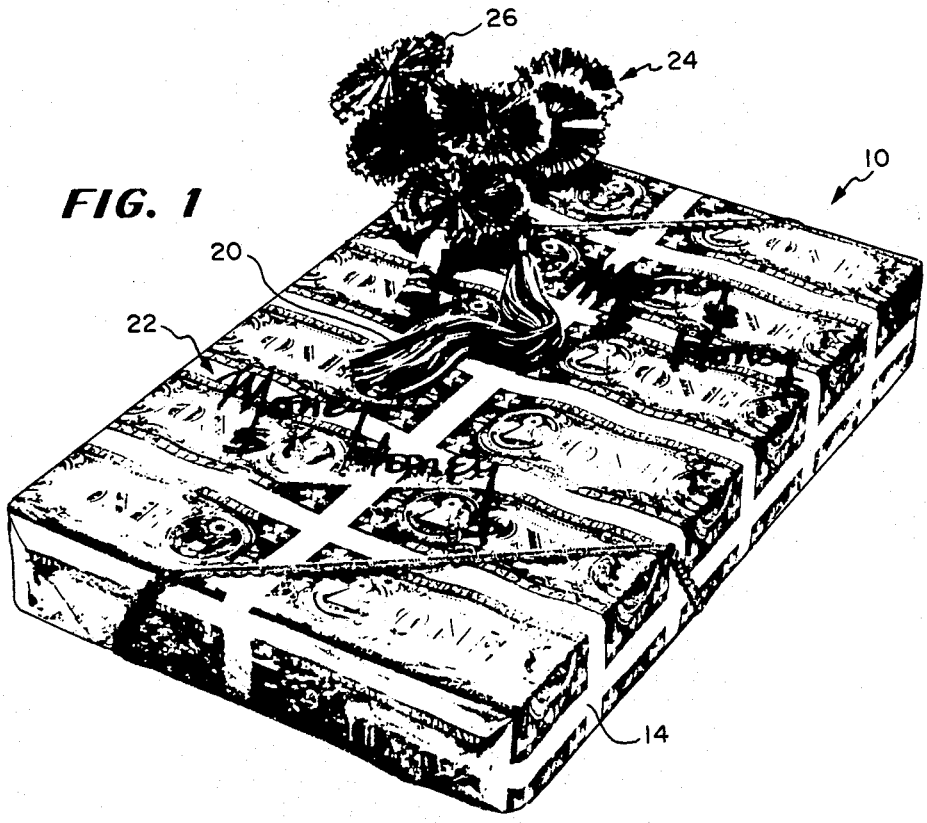
FIG. 1 is a perspective view of a package made according to the teachings of the present invention viewing same from above a front corner thereof.
Figure 2:
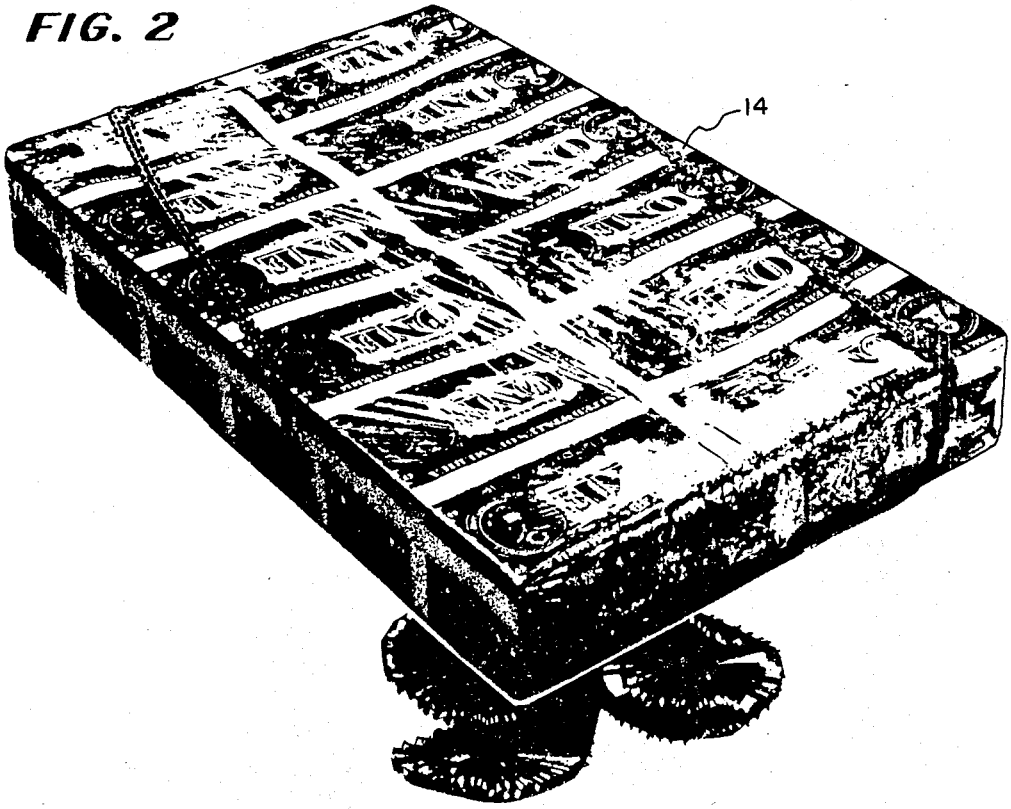
FIG. 2 is a back bottom perspective view of the package shown in FIG. 1 viewing same from below a back corner thereof.
Figure 3:
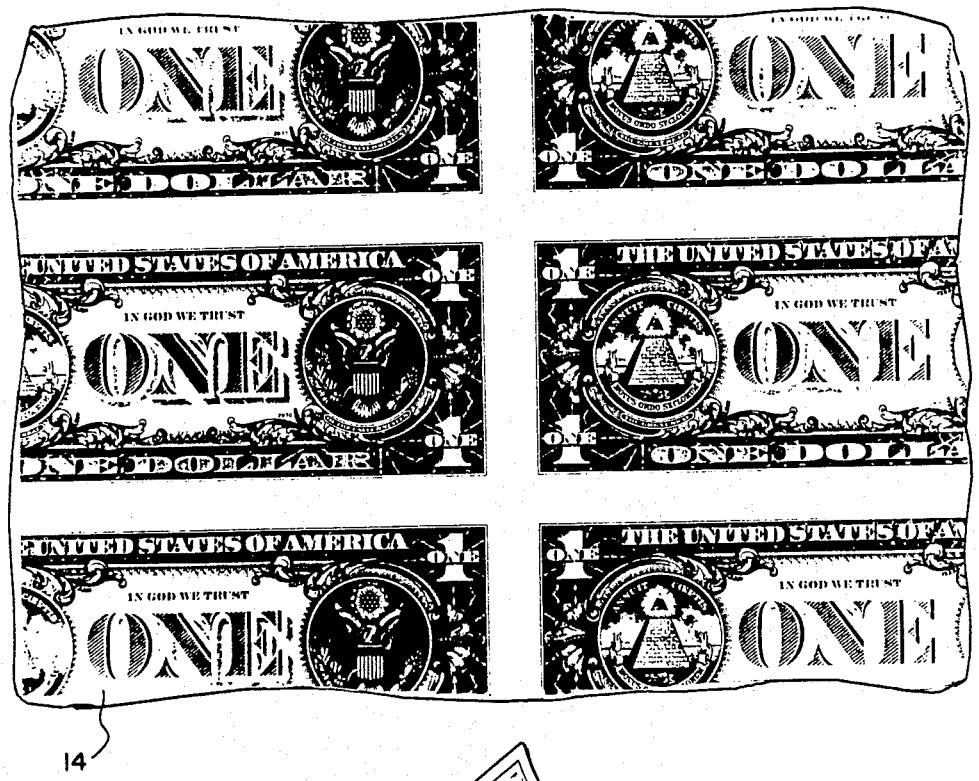
FIG. 3 is an enlarged plan view of a portion of the uncut sheet of negotiable paper currency which is wrapped about the object in the package.
Figure 4:
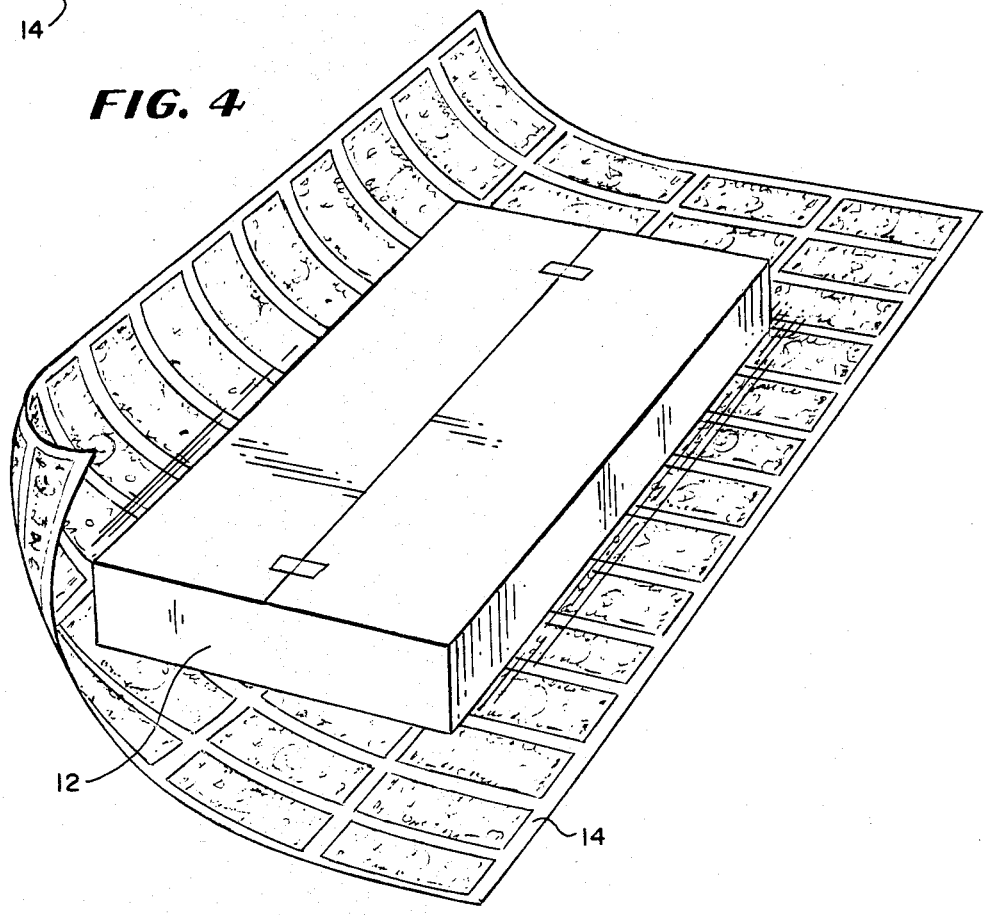
FIG. 4 is a perspective view showing an object, such as a box, being wrapped with the sheet of uncut currency.

Referring now to the drawings in greater detail, there is illustrated in FIG. 1 a complete package made in accordance with the teachings of the present invention generally identified by the reference numeral 10. The package 10 includes an object 12, such as a box, as shown in FIG. 4, about which is wrapped a sheet 14 of uncut, negotiable bills of paper or paper-like currency, i.e., uncut money, such as a sheet of United States dollar bills, as shown in FIGS. 1, 2 and 3.

Of course, other objects other than the box 12 in which the present is situated can be used. In this respect, the object 12 can be the present itself.

However, for the sake of minimizing creases and fold lines in the sheet 14 of uncut money, it is preferable that the method of the present invention be practiced with a boxlike object, such as a box containing a gift or present.

Figure 5:
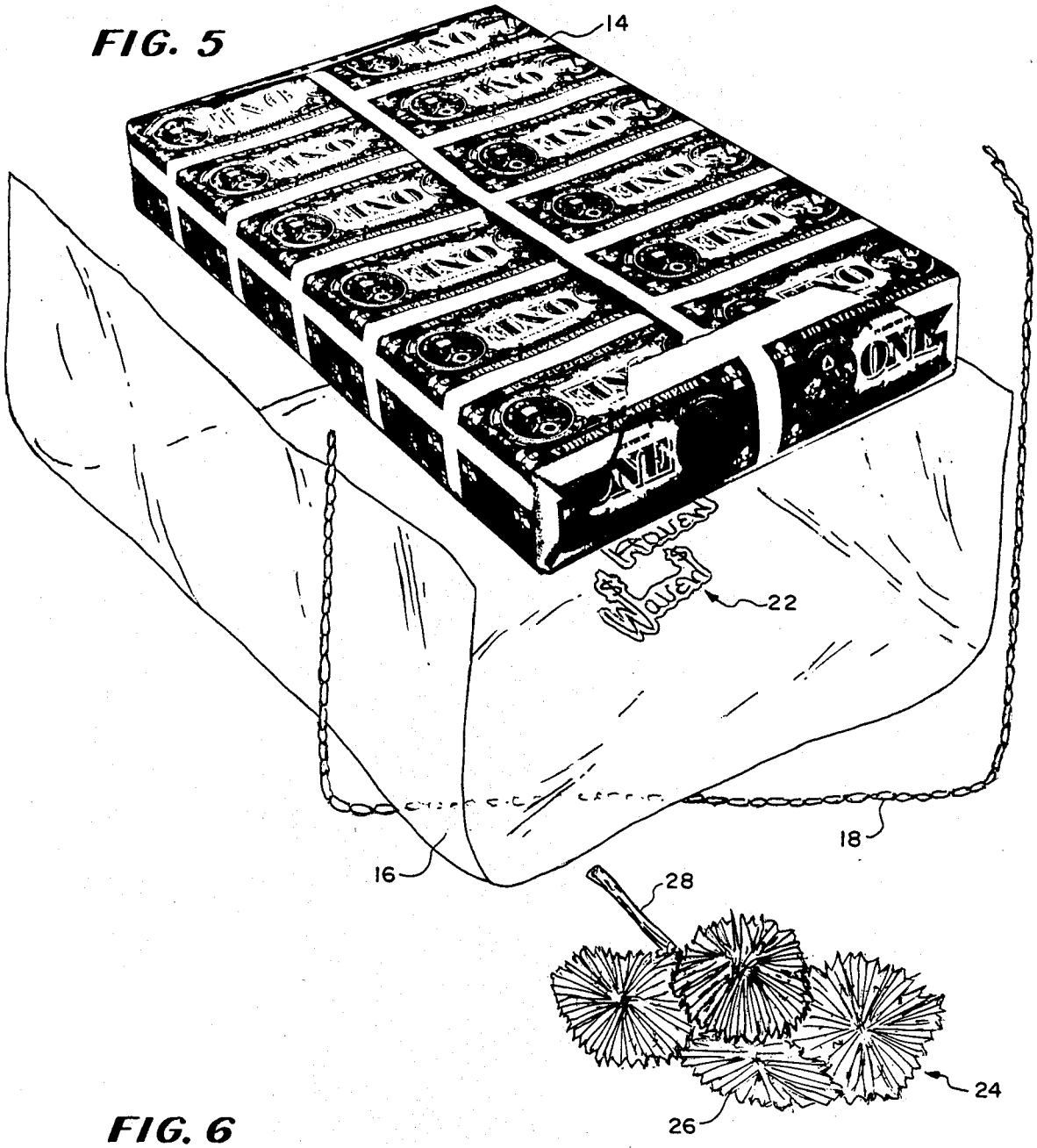
FIG. 5 is a perspective view showing the wrapped package as a protective wrapping of plastic is about to be wrapped around the package and held in place with a cord and shows a decorative item partially made of bills of negotiable currency which is preferably fixed underneath the cord.
Figure 6:
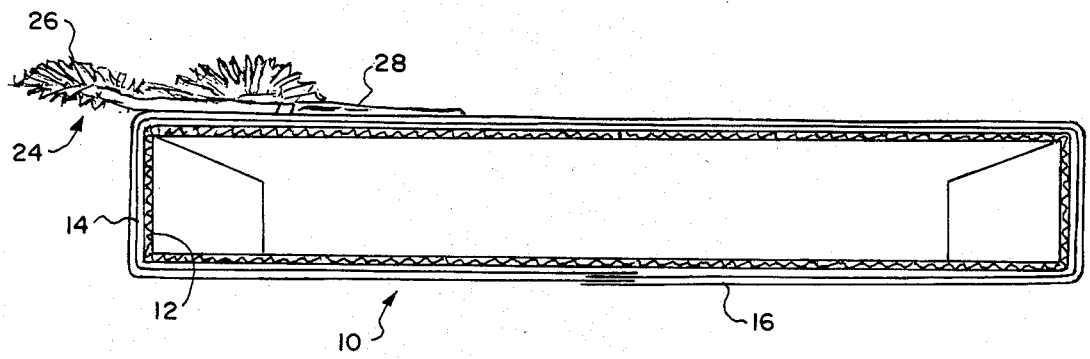
FIG. 6 is a sectional view through the package shown in FIG. 1.

The sheet of uncut money 14 can be wrapped about the box 12 in any conventional manner and one such folding arrangement of the sheet of uncut money about the box shaped object 12 is shown in FIG. 5.

Preferably, after the object 12 is wrapped with a sheet 14 of uncut money, a sheet 16 of translucent or transparent plastic material is wrapped around the wrapped sheet of uncut money to provide a protective covering over the folded uncut sheet 14 of money. This wrapping of the sheet 16 of preferably clear plastic material can be accomplished in any conventional matter, including shrink wrapping of the sheet 16 of plastic material about the object 12 wrapped with the sheet 14 of uncut money.

In one preferred embodiment the package comprising the box shaped object 12, the sheeet 14 of uncut money folded about the object 12, and the sheet 16 of clear or translucent plastic material protecting the wrapped sheet of uncut money has a gold colored cord 18 wrapped therearound, such as at angles around the corners of the package 10, as shown in FIGS. 1 and 2.

In one preferred embodiment of the package made according to the present invention, a gold tassel 20 is also attached to the cord as shown in FIG. 1.

Additionally, in a preferred embodiment of the package, the words "MONEY HONEY" are written on the package as shown by the indicia 22 in FIG. 1. Also, a slip of paper saying "GENUINE U.S. CURRENCY" is placed between the uncut money sheet 14 and the plastic sheet 16.

As further ornamentation to the box, one can also insert an item 24, which is at least partially made from bills 26 of currency, such as dollar bills, underneath the cord 18 to further decorate the package. Such an item 24 can have the appearance of a plant or flower and include a branch framework 28 to which are attached the bills 26, such as dollar bills, which are folded transversely into strip portions much like an accordian or fan and then held with a rubber band (not shown) to various ones of the branches of the framework 28 and allowed to fold out so as to give the appearance of a leaf or of a flower.

From the foregoing description, it will be apparent that the method for making the package of the present invention and the package formed thereby have a number of advantages some of which have been described above and others of which are inherent in the invention.

For example, the money is real money so that recipients of the package will be inclined not to deface or alter the wrapping of the package in any way. Rather, a recipient of the package will be induced to carefully cut the uncut sheet in a manner to separate the individual bills, such as dollar bills, from the sheet of money.

The package itself will have value in addition to the gift put inside the package.

If desired, the package can be framed.

Also if desired, the recipient of the package can deposit the whole sheet in a bank or exchange it at a bank for cut bills.

The wrapping itself can be used as a medium of exchange, since it is money.

Additionally, from the foregoing description, it will be apparent that modifications can be made to the package and method for making same of the present invention without departing from the teachings of the invention. Accordingly, the scope of the invention is only to be limited as necessitated by the accompanying claims.

I claim:

1. A method for packaging an object including the steps of:

wrapping a sheet of uncut negotiable bills of paper-like currency about the object, and fastening the wrapped sheet in place.

2. The method of claim 1 including the further step of wrapping a sheet of transparent or translucent protective material about said wrapped sheet.

3. The method of claim 2 including the step of placing the wording "MONEY HONEY" on the sheet of protective material.

4. The method of claim 1 wherein said fastening step includes tying a flexible elongate small diameter member around the wrapped sheet.

5. The method of claim 4 including the step of inserting a decorative item made at least partially of negotiable currency.

6. The method of claim 5 wherein said item is in the form of an imitation plant including a branch forming framework with the bills of negotiable currency arranged to give the appearance of leaves or flowers.

7. A package comprising an object to be wrapped, a sheet of uncut negotiable bills of paper-like currency wrapped about said object and means for fastening the wrapped sheet in place.

8. The package of claim 7 including a slip of paper or the like with the words "GENUINE U.S. CURRENCY" situated between said sheet of uncut currency and said sheet of protective material.

9. The package of claim 7 including a sheet of transparent or translucent protective material wrapped about said wrapped sheet of negotiable bills of paper-like currency.

10. The package of claim 9 including the wording "MONEY HONEY" on said sheet of protective material.

11. The package of claim 7 wherein said fastening means includes a flexible elongate small diameter member, such as a cord or string, tied around the wrapped sheet of uncut negotiable paper-like currency.

12. The package of claim 11 including a decorative item made at least partially of bills of negotiable currency inserted beneath said cord.

13. The package of claim 12 wherein said item is in the form of an imitation plant including a branch forming framework with the bills of negotiable currency attached to the framework and arranged to give the appearance of leaves or flowers.

14. The package of claim 7 including a tassel connected to said flexible elongate member.

15. The package of claim 14 wherein said tassel and said flexible elongate member have a gold color.

* * * * *